US007280126B2

(12) United States Patent
Kempf

(10) Patent No.: US 7,280,126 B2
(45) Date of Patent: Oct. 9, 2007

(54) METHODS AND APPARATUS FOR CONVERTING AN ORTHOGONAL PIXEL FORMAT TO A DIAMOND PIXEL FORMAT

(75) Inventor: Jeff Kempf, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 440 days.

(21) Appl. No.: 10/682,010

(22) Filed: Oct. 9, 2003

(65) Prior Publication Data

US 2004/0239657 A1 Dec. 2, 2004

Related U.S. Application Data

(60) Provisional application No. 60/474,640, filed on May 30, 2003.

(51) Int. Cl.
*G09G 5/02* (2006.01)

(52) U.S. Cl. ..... 345/694; 345/696; 345/698

(58) Field of Classification Search ..... 345/694–699, 345/618; 348/445, 446; 382/260, 266; 708/300, 708/320

See application file for complete search history.

(56) References Cited

U.S. PATENT DOCUMENTS

| | | | | |
|---|---|---|---|---|
| 5,061,049 | A | 10/1991 | Hornbeck | |
| 5,280,277 | A | 1/1994 | Hornbeck | |
| 5,905,817 | A * | 5/1999 | Matama | 382/260 |
| 6,522,356 | B1 * | 2/2003 | Watanabe | 348/272 |
| 6,928,196 | B1 * | 8/2005 | Bradley et al. | 382/300 |

* cited by examiner

*Primary Examiner*—Kevin M. Nguyen
(74) *Attorney, Agent, or Firm*—Wade James Brady, III; Frederick J. Telecky, Jr.

(57) ABSTRACT

Apparatus for converting orthogonal data to a format suitable for displaying the image on a diamond-shaped pixel array. A stream of digital data formatted for being displayed on an orthogonal pixel array is received at an IIR (Infinite Impulse Response) filter. The digital data stream is conditioned so that it can be sub-sampled and used on a diamond-shaped pixel array with minimal distortion. The sub-sampling comprises dropping even pixels in odd numbered orthogonal rows and dropping odd pixels on all even numbered rows. A tap is included at the IIR filter for providing a partially filtered version of the data stream to circuitry for reducing "ringing" of the image. The circuitry also detects edges in the image and emphasizes vertical transitions when a vertical edge is detected and emphasizes horizontal transitions when a vertical edge is not detected.

21 Claims, 9 Drawing Sheets

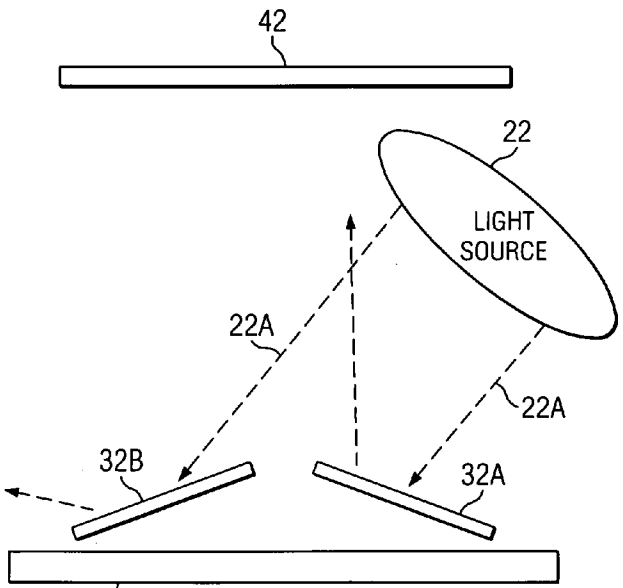
FIG. 4
(PRIOR ART)
FIG. 3
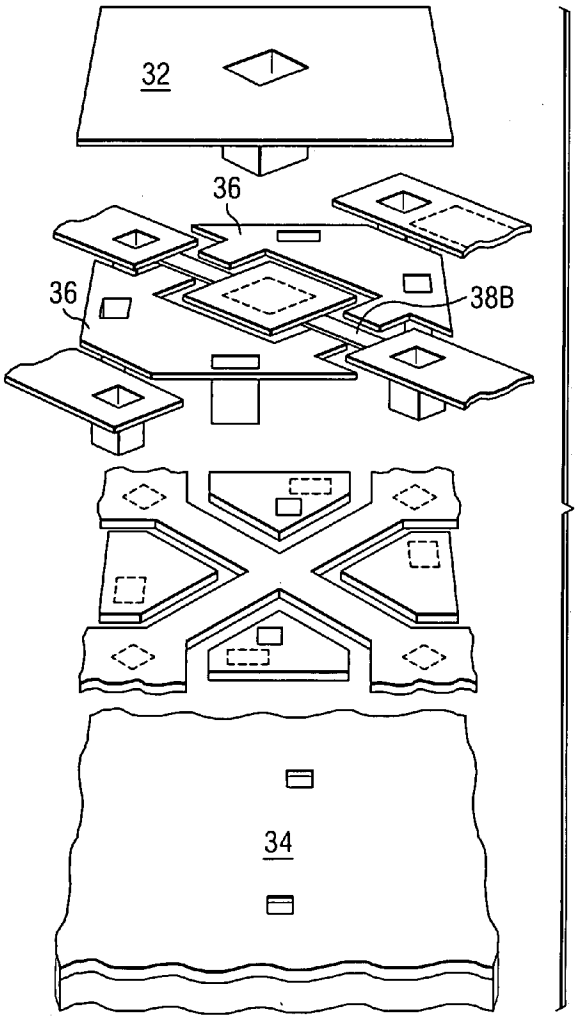

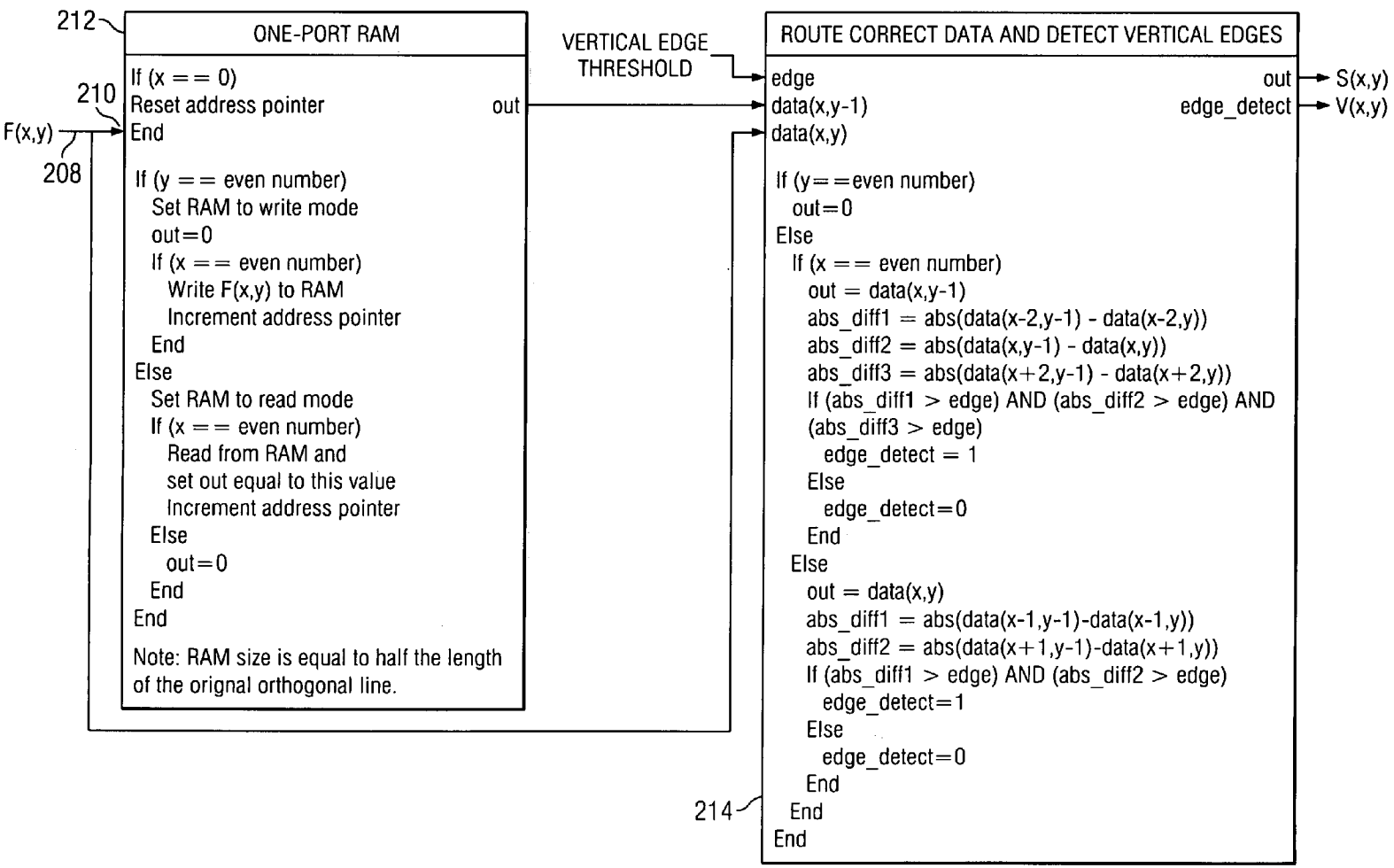
FIG. 14A
ONE-PORT RAM
If (x == 0)
Reset address pointer
End
If (y == even number)
Set RAM to write mode
out=0
If (x == even number)
Write F(x,y) to RAM
Increment address pointer
End
Else
Set RAM to read mode
If (x == even number)
Read from RAM and
set out equal to this value
Increment address pointer
Else
out=0
End
End
Note: RAM size is equal to half the length
of the orignal orthogonal line.
out
212
210
208
F(x,y)
VERTICAL EDGE
THRESHOLD
FIG. 14B
ROUTE CORRECT DATA AND DETECT VERTICAL EDGES
edge
data(x,y-1)
data(x,y)
out
edge_detect
If (y==even number)
out=0
Else
If (x == even number)
out = data(x,y-1)
abs_diff1 = abs(data(x-2,y-1) - data(x-2,y))
abs_diff2 = abs(data(x,y-1) - data(x,y))
abs_diff3 = abs(data(x+2,y-1) - data(x+2,y))
If (abs_diff1 > edge) AND (abs_diff2 > edge) AND
(abs_diff3 > edge)
edge_detect = 1
Else
edge_detect=0
End
Else
out = data(x,y)
abs_diff1 = abs(data(x-1,y-1)-data(x-1,y))
abs_diff2 = abs(data(x+1,y-1)-data(x+1,y))
If (abs_diff1 > edge) AND (abs_diff2 > edge)
edge_detect=1
Else
edge_detect=0
End
End
End
214
S(x,y)
V(x,y)

METHODS AND APPARATUS FOR CONVERTING AN ORTHOGONAL PIXEL FORMAT TO A DIAMOND PIXEL FORMAT

This application claims the benefit of U.S. Provisional Application No. 60/474,640, filed on May 30, 2003, entitled "Spatial Light Modulator with Diamond Pixels," which application is hereby incorporated herein by reference.

TECHNICAL FIELD

The present invention relates generally to a system and method for displaying digital data, and more particularly to a system and method for converting a standard orthogonal digital pixel format suitable for display on an orthogonal-shaped pixel array to a diamond-shaped pixel format for display on a diamond-shaped pixel array.

BACKGROUND

Referring to FIG. 1, an example of a DMD™ (digital micro-mirror device) system 20 is illustrated, wherein the light from a light source 22 is applied through a first lens 24 and through a color wheel 26, which will typically rotate no less than about 60 revolutions or 60 frames per second. Alternately, the color wheel 26 may make up to five or six revolutions per frame or about 300-350 revolutions per second. The light passing through the color wheel 26 passes through a second lens 28 onto a DMD™ array or chip 30. The DMD™ chip includes an array (on the order of one million) of tiny mirror elements, or micro-mirrors, where each mirror element is hinged by a torsion hinge and support post above a memory cell of a CMOS static RAM as shown in FIG. 2 and FIG. 3.

FIGS. 2 and 3 show a portion of a typical DMD™ array 30 having mirror elements 32 suspended over a substrate 34. Electrostatic attraction between the mirror 32 and an address electrode 36 causes the mirror to twist or pivot, in either of two directions, about an axis formed by a pair of torsion beam hinges 38*a* and 38*b*. Typically, the mirror rotates about these binges until the rotation is mechanically stopped. The movable micro-mirror tilts into the on or off states by electrostatic forces depending on the data written to the cell. The tilt of the mirror is on the order of plus 10 degrees (on) or minus 10 degrees (off) to modulate the light that is incident on the surface. For additional details, see U.S. Pat No. 5,061,049 entitled "Spatial Light Modulator" and U.S. Pat. No. 5,280,277 entitled "Field Updated Deformable Mirror Device," both by Larry J. Hornbeck.

Referring again to FIG. 1, the light reflected from all, selected ones, or none of the mirrors may pass through a projection lens 40 and create images on the screen 42. The DMD™s are controlled by electronic circuitry fabricated on the silicon substrate 34 under the DMD™ array. The circuitry includes an array of memory cells, typically one memory cell for each DMD™ element, connected to the address electrodes 36. The output of a memory cell is connected to one of the two address electrodes and the inverted output of a memory cell is connected to the other address electrode. Data is provided by a timing and control circuit 44 determined from signal processing circuitry and an image source indicated at 46. Once data is written to each memory cell in the array, a voltage is applied to the DMD™ mirrors 32 creating a large enough voltage differential between the mirrors 32 and the address electrodes 36 to cause the mirror to rotate or tilt in the direction of the greatest voltage potential. Since the electrostatic attraction grows stronger as the mirror is rotated near an address electrode, the memory cell contents may be changed without altering the position of the mirrors once the mirrors are fully rotated. Thus, the memory cells may be loaded with new data while the array is displaying previous data.

DMD™ arrays are typically operated in a dark-field mode. In one embodiment of dark-field operation shown in FIG. 4, light 22*a* from light source 22 is focused on DMD™ array 30 and strikes the individual mirrors of the array 30 at an angle. According to the example shown in FIG. 4, when tilted or rotated to an ON position as indicated by mirror 32*a*, light 22*a* incident the mirror 32*a* will be reflected and focused onto an image plane or viewing screen 42 where it will form part of the image. If a mirror 32*b* is rotated away from the light source to an OFF position, light 22*a* incident the mirror 32*b* will reflect away from the viewing screen 42 and will not form part of the image.

Light incident on and reflected from a DMD™ mirror forms an illuminated dot on the viewing screen 42 for every mirror 32 that is rotated to the "ON" position. Each of these dots represents one picture element, or pixel, which is the smallest individually controllable portion of an image. Using a large array of these tiny mirrors, an image is created by selectively turning some mirrors to the "ON" position while turning some to the "OFF" position, thereby creating a pattern of illuminated dots on the viewing screen.

A major production cost of DMD™ modules or mirror arrays for use as display drive engines is the silicon wafer and corresponding processing costs. Of course, if the number of modules that could be manufactured from a single wafer could be substantially increased, this increase would have a direct affect on the cost of the modules. A diamond-shaped array having the same number of rows and columns of pixels is only half the size of an orthogonal array and uses only half the number of pixels. Comparing the 8 column by 6 row orthogonal array of FIG. 5A with the 8 column by 6, row diamond-shaped array of FIG. 5B illustrates that even though the size of the pixels are the same, the diamond-shaped array is only about one half the size of the orthogonal pixel array. The difference in the overall size and total number of pixels of an 8×6 orthogonal array and an 8×6 diamond array is due to the difference in distance between adjacent horizontal and vertical pixels. For example, for an orthogonal array, and as shown in FIG. 5A, the distance between adjacent rows, as indicated by double-headed arrow 50, is the same or equal to the distance between adjacent columns, as indicated by double-headed arrow 52. However, as shown in the diamond array of FIG. 5B, the distance between adjacent rows, as indicated by double-headed arrow 54, is only half that between adjacent columns, as indicated by double-headed arrows 56*a* and 56*b*. This is, of course, because there are actually two sets of columns. Namely, a first set for odd rows as indicated by reference number 58 and a second set of even rows as indicated by 60.

Therefore, to maintain a particular or selected aspect ratio, the number of columns in a diamond array will be one half that of its orthogonal counterpart. Thus, it will be appreciated that if the "orthogonal" digital data format that is typically used with digital displays could be used with a diamond-shaped array, a fifty percent reduction in size would be appreciated. The fifty percent reduction in size would translate to substantially double the number of dies per wafer. Consequently, yield per wafer could be significantly improved by using a diamond array.

It should also be appreciated that the present invention is discussed with respect to reducing the size of the mirror array so as to increase yield. Alternately, however, the number of pixels and, consequently a diamond array used to replace an orthogonal array could remain the same size as an orthogonal array. In this event, rather than an increase in yield, the resolution would be increased. However, as will also be understood from the discussion below, although doubling the number of pixels will increase the resolution, it will not double the resolution.

Conversely, loss in resolution will occur with the conversion from an orthogonal to a diamond array. For example, the bandwidth of the Horizontal and Vertical frequency of a diamond array is illustrated in FIG. 6. As shown, FIG. 6 is a plot of a 128-point two-dimensional fast Fourier transform (FFT) used to determine the frequency response where "0" corresponds to the frequency minus $\pi$, and 128 corresponds to the frequency plus $\pi$. The frequency plot indicated by the raised area 62 illustrates how the diamond array maintains the highest Horizontal and Vertical frequencies as illustrated by solid arrows 64*a* and 64*b* respectively, but only half the bandwidth of the highest Diagonal frequency as indicated by dashed arrows 66*a* and 66*b*. That is, the Horizontal and Vertical frequencies indicated at coordinates 68 and 70, respectively, include the full range of frequencies as indicated by arrows 64*a* and 64*b*, whereas the Diagonal values indicated by dashed arrow 66*a* is only half that of the Diagonal frequency for an orthogonal array as indicated by arrow 72.

This change in bandwidth is further illustrated in the display of FIGS. 7A through 9A and FIGS. 7B through 9B showing how the diamond array image was created by sub-sampling the orthogonal array. This sub-sampling was accomplished by removing the even pixels from the orthogonal array for odd rows in a diamond array and removing the odd pixels from the orthogonal array for the even rows in the diamond array. For example, FIG. 7A illustrates how vertical lines 74, 76, 78 and 80 of pixels of four different colors shown in an orthogonal array can be reproduced as lines 74*a*, 76*a*, 78*a* and 80*a* in the diamond array of FIG. 7B. Likewise, FIG. 8A illustrates that horizontal lines 82, 84 and 86 of different colors in the orthogonal array can be reproduced as lines 82*a*, 84*a* and 86*a* of FIG. 8B. However, since converting from an orthogonal array to a diamond array by this type of sub-sampling results in every other pixel on each line being removed, the diagonal lines 88, 90, 92, 94, 96 and 98 of the orthogonal array of FIG. 9A cannot be reproduced by the diamond array of FIG. 9B. The inability to produce the diagonal rows by this simple sub-sampling method is a result of the distortion caused by the interaction between the signal frequency and the sampling frequency hereinafter referred to as aliasing. The spaces in the angled letter "V" in the city names "Vancouver" and "Victoria" of FIGS. 10A and 10B illustrates the results of aliasing. More specifically, or as is better illustrated in the enlarged view of FIG. 10B, the result of removing the pixels in the conversion is obvious. FIG. 10C shows the visual improvement when the aliasing is removed.

Therefore, methods and apparatus for using a diamond-shaped array without unacceptable loss of resolution and increased artifacts would clearly be advantageous.

SUMMARY OF THE INVENTION

These and other problems are generally solved or circumvented, and technical advantages are generally achieved, by embodiments of the present invention which provides apparatus and methods for converting digital data signals representing an image suitable for display with an orthogonal pixel array such that the converted digital data is suitable for displaying the image on a diamond-shaped pixel array.

According to one embodiment of the invention, the methods and apparatus comprises receiving a stream of digital data signals representing an image to be displayed on an orthogonal pixel array. The data stream is provided to an IIR (Infinite Impulse Response) filter for conditioning the received digital data stream such that it can be sub-sampled and used on a diamond-shaped pixel array with minimal distortion caused by aliasing. The filtered data stream is then sub-sampled for use on a diamond-shaped pixel array by dropping data that controls even pixels on all odd numbered orthogonal rows and also dropping data that controls odd pixels on all even numbered rows.

According to another embodiment of the invention, the IIR filter includes a plurality of stages and an output tap connection at the output of one of the plurality of stages for providing a partially filtered output data stream to Ringing Minimization circuitry. The Ringing Minimization circuitry uses this partially conditioned data stream to provide a Ringing Minimization signal. The ringing minimization signal is then combined with the filtered data stream to generate a version of the filtered data stream that results in reduced "ringing" of the image when displayed.

According to a further embodiment, the filtered data stream is received at circuitry that detects the presence of vertical edges in the image and is then provided to switching circuitry that selectively connects the filtered sub-sample data stream to a first high frequency filter when a vertical edge is detected and to a second high frequency filter when a vertical edge is not detected. The two high frequency filters emphasize a vertical or horizontal edge. For example, the sub-sampled filtered data is applied across three line-interleaved pixels when the first high frequency filter is selected (emphasizes a vertical edge) and is applied across three horizontally adjacent pixels when the second high frequency filter is selected (emphasizes horizontal edges).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawing, in which:

FIG. 3 is an exploded view of the DMD™ of FIG. 2;

FIG. 4 is a schematic representation of the bi-stable operation of two mirrors of the DMD™ array of FIG. 2;

FIGS. 14A and 14B are block diagrams illustrating a one PORT RAM and vertical edge detection circuitry as taught by the present invention;

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

As was discussed above with respect to FIGS. 5A and 5B, sub-sampling the original orthogonal pixel data to convert to a diamond format introduces aliasing. This artifact is a result of removing half of the pixels from the orthogonal image and moving the relative position of these remaining pixels.

Figure 11A:
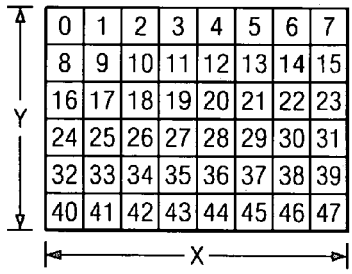
FIGS. 11A and 11B are similar to FIGS. 5A and 5B and show the data stream order for an orthogonal array.
Figure 11B:
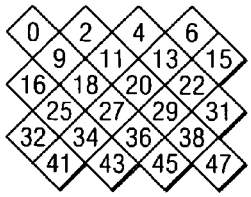
Figure 11C:
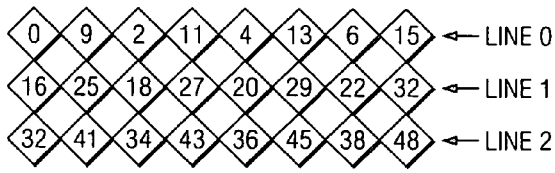
FIG. 11C shows sub-sampled data for a diamond array interleaved with data rows to allow use of existing format circuitry.

For example, referring now to FIGS. 11A, 11B and 11C, there is illustrated the sub-sampling of the orthogonal pixel array data to obtain the pixel data for use with a diamond-shaped array. FIGS. 11A and 11B are similar to FIGS. 5A and 5B discussed above, and therefore, common elements carry common reference numbers. In the 8×6 orthogonal illustration of FIG. 11A, the first 8 sets of data numbered 0-7 are provided for the first orthogonal row. In a similar manner, data sets numbered 8-15, 16-23, 24-31, etc., are provided for orthogonal rows 2 through 6. However, referring to FIG. 5B, it is seen that the pixel with data set 2 is now adjacent to the pixels holding data sets 0 and 4 rather than the pixels holding data sets 1 and 3, which have been removed by sub-sampling. Likewise, considering the vertical arrangement, the pixel holding data set 25 is now adjacent to the vertical pixels holding data sets 9 and 41 rather than the pixels holding data sets 17 and 33. Therefore, it should be appreciated that adjusting or conditioning of the pixels used in the diamond array to compensate for the dropped pixels will help eliminate errors or artifacts. This type of conditioning to remove aliasing has typically been achieved by the use of a low-pass filter, and more specifically, by the use of an FIR (Finite Impulse Response) filter. In the past, FIR filters were typically selected for such sample rate conversion problems over IIR (Infinite Impulse Response) filters, because FIR filters are inherently linear-phase while the prior art IIR filters resulted in phase distortion problems.

The present invention, however, uses a unique Linear Phase IIR (Infinite Impulse Response) Filter to adjust or condition each pixel prior to the sub-sampling that avoids the problems of the prior art IIR filters.

Figure 12:
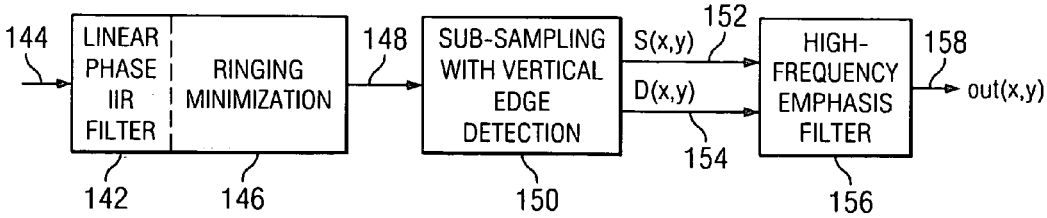
FIG. 12 is a block diagram of circuitry of the present invention for converting a digital data stream generated for being displayed on an orthogonal array to a suitable format for displaying on a diamond array.

Referring now to FIG. 12, there is shown a block diagram of circuitry for converting a stream of digital data suitable for display on an orthogonal pixel array, such as shown in FIG. 11A, to a format for display on a diamond-shaped pixel array, such as shown in FIG. 11B. Although only one input $I_n(x,y)$ is shown and discussed with respect to a color display, it will be appreciated that there can be a circuit similar to that shown in FIGS. 12 and 13 for each of the primary color signals of a display data stream. As will also be appreciated for most applications and signal sources for color displays whether digital TV or movies, etc., there will be three primary color signals of red, green and blue and, consequently, three circuits, similar to FIG. 12 and FIG. 13. Therefore, as shown in FIG. 12, a stream of input digital data is provided to the Linear Phase IIR Filter circuit 142 on line 144. After passing through the IIR Filter, the modified data stream is provided to Ringing Minimization circuitry 146 shown in the same block as IIR Filter circuitry 142, but separated by a dotted line. Although the Ringing Minimization circuitry 146 is not actually part of the IIR Filter circuitry 142, it is illustrated as part of the same circuit block because it requires inputs corresponding to intermediate results already calculated by the IIR Filter circuitry 142. The filtered input with Ringing Minimization is then provided as an output from the Ringing Minimization circuitry 146 on line 148 which in turn is provided to the Sub-Sampling with Vertical Edge Detection circuitry 150 referred to hereinafter as the "Sub-Sampling circuitry." Sub-Sampling circuitry 150 will be discussed in greater detail below, but basically comprises a first high-pass filter that is applied across three line-interleaved pixels that emphasize vertical edges without requiring an additional line of memory if a vertical edge is detected. On the other hand, if a vertical edge is not detected, a high-pass filter is applied only across three horizontally adjacent pixels. Thus, as shown, Sub-Sampling circuitry 150 provides an output signal S (x, y) for each pixel on line 152. A second signal D (x, y), indicating whether or not a vertical edge is detected, is provided with the pixel signal as indicated on line 154. These outputs on lines 152 and 154 from Sub-Sampling circuitry 150 are provided as inputs to the "High-Frequency Emphasis Filter" 156 which then filters the data on line 152 with the correct high-pass filter, a vertical high-pass filter when line 154 is equal to one and a horizontal high-pass filter when line 154 is equal to zero. The results of the selected high-pass filter are gained and added into the non-filtered data stream, line 152, and form the output data stream, line 158.

Figure 13:
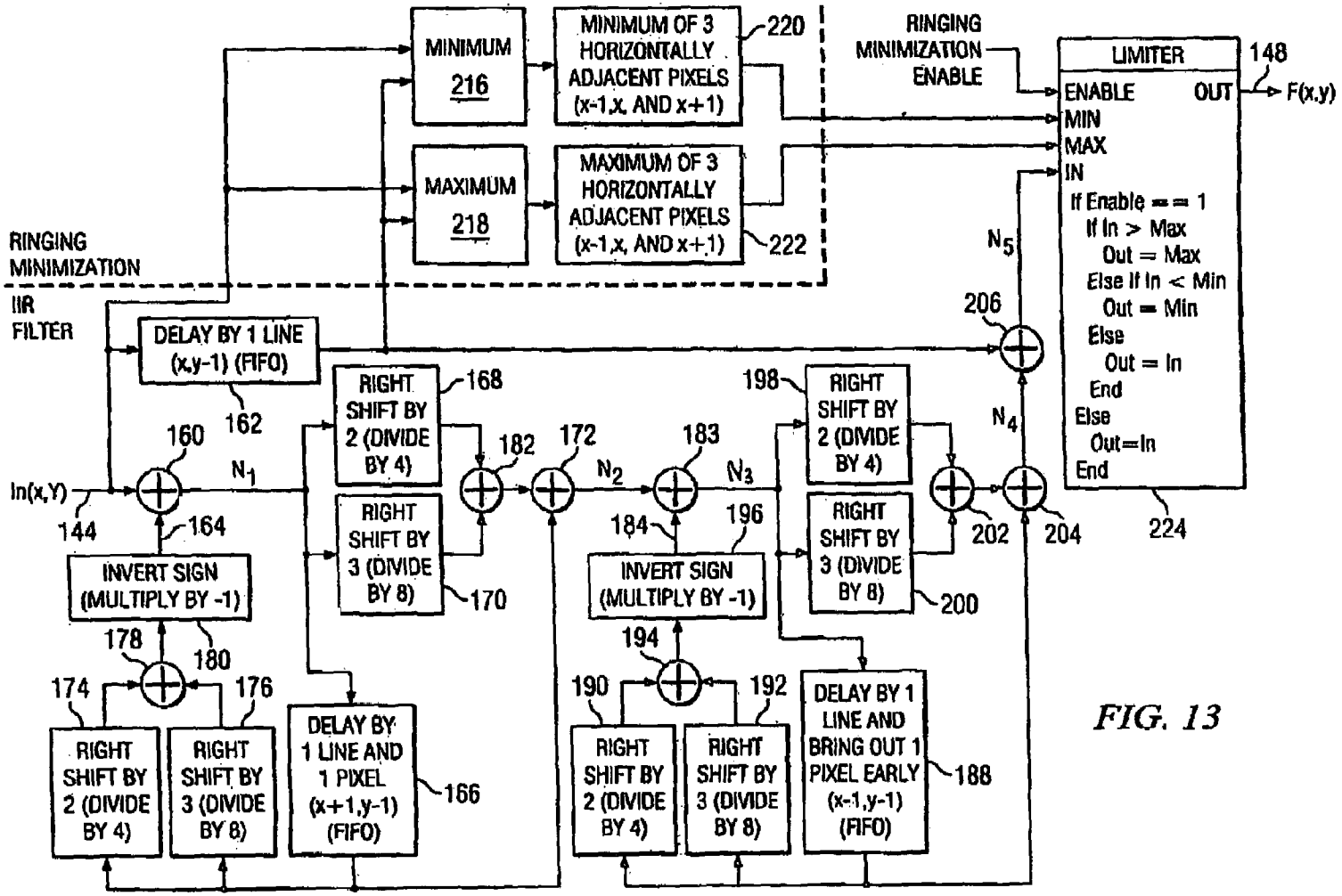
FIG. 13 is a detailed block diagram of the "Linear Phase IIR Filter" and "Ringing Minimization" circuitry of FIG. 12.

As shown in FIG. 13, the $I_n(x,y)$ signal is received on line 144 and is provided to sub-circuits of the IIR circuitry 142 and Ringing Minimization circuitry 146. The Ringing Minimization circuitry 146 will be discussed later. The $I_n(x,y)$ signal is provided to an "Add" sub-circuit 160 and a Delay sub-circuit 162 in the IIR Filter. From the figures, it is seen that the $I_n(x,y)$ circuitry is added to another signal arriving on line 164 also received at "Add" circuit 160 to generate a combined signal at node $N_1$. The generated signal received at node $N_1$ is provided to a Delay sub-circuit 166, a Right Shift By 2 circuit 168 and a Right Shift By 3 circuit 170. Referring again to FIGS. 11A and 11B, there is shown a pixel 18 in the orthogonal array of FIG. 11A, which will have a data set arriving on line 144 of the filter circuit of FIG. 13 as $I_n(x,y)$ where $I_n$ represents the binary data that determines the signal intensity. The (x,y) identifies the row(x) and column(y) of the pixel that is to be adjusted or conditioned by the circuitry of FIG. 13. In the example of FIG. 11A, x=3 and y=3 for pixel 18.

Thus, the signal for each pixel is received at node $N_1$ by Delay circuitry 166 is delayed for a full line (or row of pixels) plus one pixel when referenced to the orthogonal pixel represented by the present $I_n(x,y)$ signal. However, it will also be appreciated that in the example, data for pixel 18 is combined with a negative portion (0.375) of the data for pixel 9 that was previously delayed by one row plus one pixel. More specifically, a negative portion of the signal $I_n(2,2)$ for pixel 9 is combined with the signal $I_n(3,3)$ for pixel 18 by "Add" circuit 160 to generate the signal at node $N_1$. It will also be appreciated that the full negative value of 0.375 $N_1(2,2)$ is not combined with $I_n(3,3)$ since the $I_n(2,2)$ value has itself been adjusted in a similar manner before being combined. Thus, the delayed signal from delay circuit 166 is also provided to another "Add" circuit 172, which will be discussed later, as well as to a "Right Shift By 2" 174 and a "Right Shift By 3" circuit 176. These two shifted values are then combined at "Add" circuit 178 before being inverted (i.e., sign change) by inverter circuitry 180. The output of inverter circuitry 180 is the signal on line 164 provided to "Add" circuit 160 described above. Thus, the signal at node $N_1$ is comprised of the $I_n(x,y)$ signal on line 144 which is combined by "Add" circuit 160 with the signal on line 164. Therefore, a signal at $N_1$ can be determined and represented by the equation 1 below.

$$N_1(x,y)=I_n(x,y)-0.375N_1(x+1,y-1) \qquad \text{Equation 1.}$$

More specifically, the term "$I_n(x,y)$" in equation 1 is, of course, the original input signal. The "$N_1(x+1,y-1)$" portion of the equation is the value of the signal at node $N_1$ for a pixel delayed by one line or row (y−1) and one pixel (x+1). The 0.375 represents the combined output from "Add" circuit 178. The components of the "Add" circuit 178 include a pixel shift of two positions to the right. In a digital binary system, this is, of course, the same as dividing by four and is provided by shift circuitry 174. Thus, ¼=0.25. Similarly, the output of shift circuit 176 results in a right shift of three, which in a digital binary system, is the same as dividing by eight. Thus, ⅛=0.125. Combining 0.25 and 0.125 results in 0.375(0.125+0.25=0.375). Finally, inverter circuitry 180 changes the positive value of 0.375 to a negative value of 0.375 to yield the "$-0.375N_1(x+1,y-1)$" input portion of the "Add" circuit 160. The value at node $N_2$ is determined in a similar manner. For example, as discussed above, the $N_1$ node value is provided to "Right Shift By 2" circuitry 168 and "Right Shift By 3" circuitry 170. The output of these "Right Shift" circuits are the same as a divide by eight and a divide by four circuit, as was discussed above. Thus, we again have the value of 0.25+0.125=0.375 provided to an "Add" circuit 182 to arrive at $0.375N_1(x,y)$. This value is combined with the output $N_1(x+1,y-1)$ from Delay circuit 166 as discussed above by "Add" circuit 172. Therefore, the signal value at node $N_2$ may be expressed by equation 2.

$$N_2(x,y)=N_1(x+1,y-1)+0.375N_1(x,y) \qquad \text{Equation 2.}$$

The value of node $N_3$ is expressed in equation 3 below and is also determined in a similar manner.

$$N_3(x,y)=N_2(x,y)-0.375N_3(x-1,y-1) \qquad \text{Equation 3.}$$

As can be seen, the signal value of $N_3$ is the signal value at node $N_2$ (i.e., $N_2(x,y)$) combined with the value on line 184 by "Add" circuit 183. The signal value on line 184 is determined by Delay circuit 188, "Right Shift By 2" circuit 190, "Right Shift By 3" circuit 192 "Add" circuit 194 and Invert circuit 196 in exactly the same way as the signal generated on line 164 provided to "Add" circuit 160 discussed above. The only difference is that Delay circuit 188, delays the signal one row or line "less" one pixel (i.e., data for pixel 11) rather than one row or line "plus" one pixel (i.e., data for pixel 9).

The signal value at node $N_4$ is determined in exactly the same manner as the value at $N_2$ by the "Right Shift By 2" circuit 198, "Right Shift By 3" circuit 200 and "Add" circuit 202 and 204.

$$N_4(x,y)=N_3(x-1,y-1)+0.375N_3(x,y) \qquad \text{Equation 4.}$$

The final result or output of the IIR Filter 142 indicated at $N_5$ is the value of $N_4$ combined by "Add" circuit 206 with a one line delay provided by "Delay" circuitry 162 mentioned above. The equation for the $N_5$ node is:

$$N_5(x,y)=N_4(x,y)+I_n(x,y-1) \qquad \text{Equation 5.}$$

Figure 1:
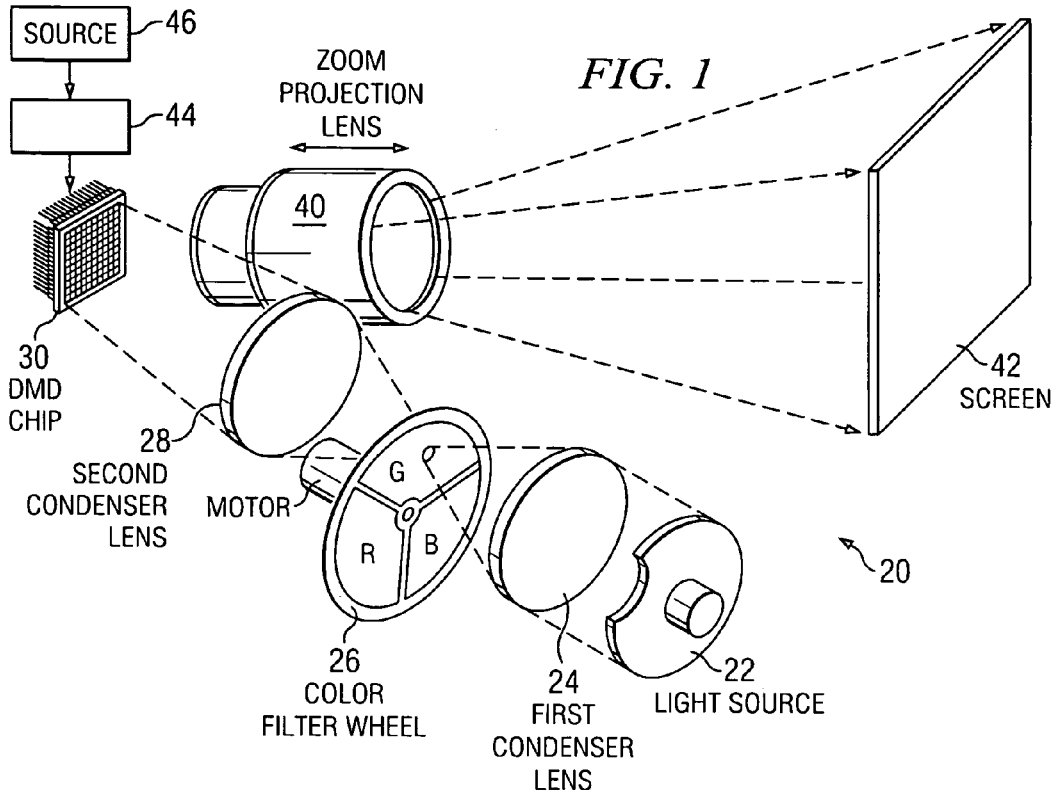
FIG. 1 is an overall schematic of a prior art Digital Micro-mirror Display System that can benefit from the teachings of this invention.
Figure 2:
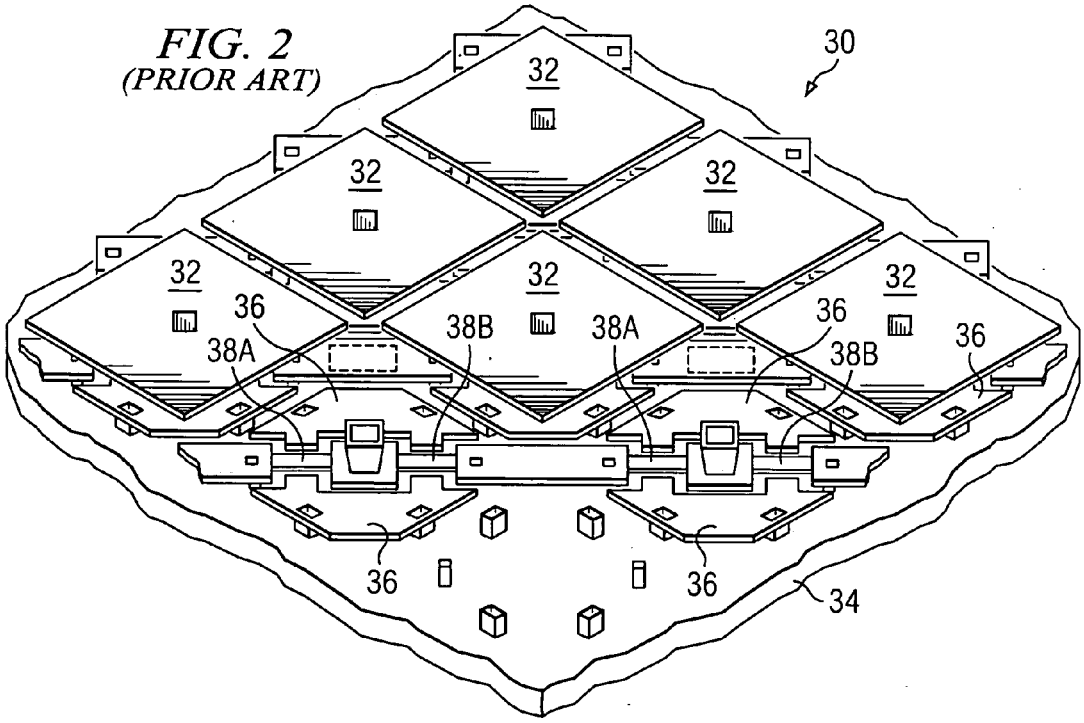
FIG. 2 (PRIOR ART)
FIG. 2 is a perspective view of a portion of a Digital Micro-mirror Device (DMD™) array of the prior art.
Figure 5A:
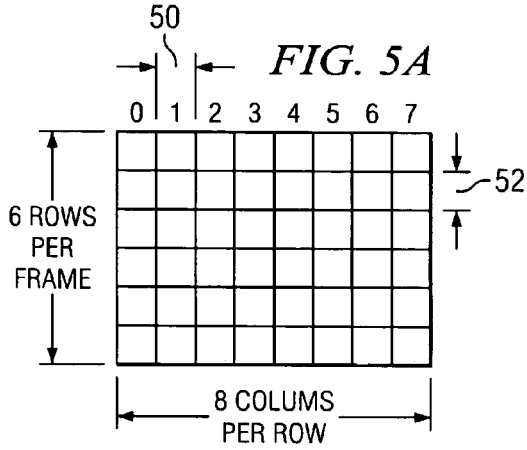
FIGS. 5A and 5B illustrate the reduction in physical size of a display array by using a diamond-shaped array rather than an orthogonal array.
Figure 5B:
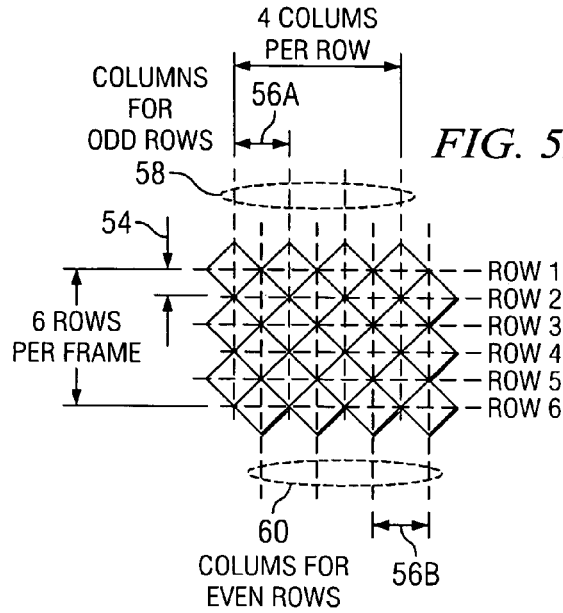
Figure 6:
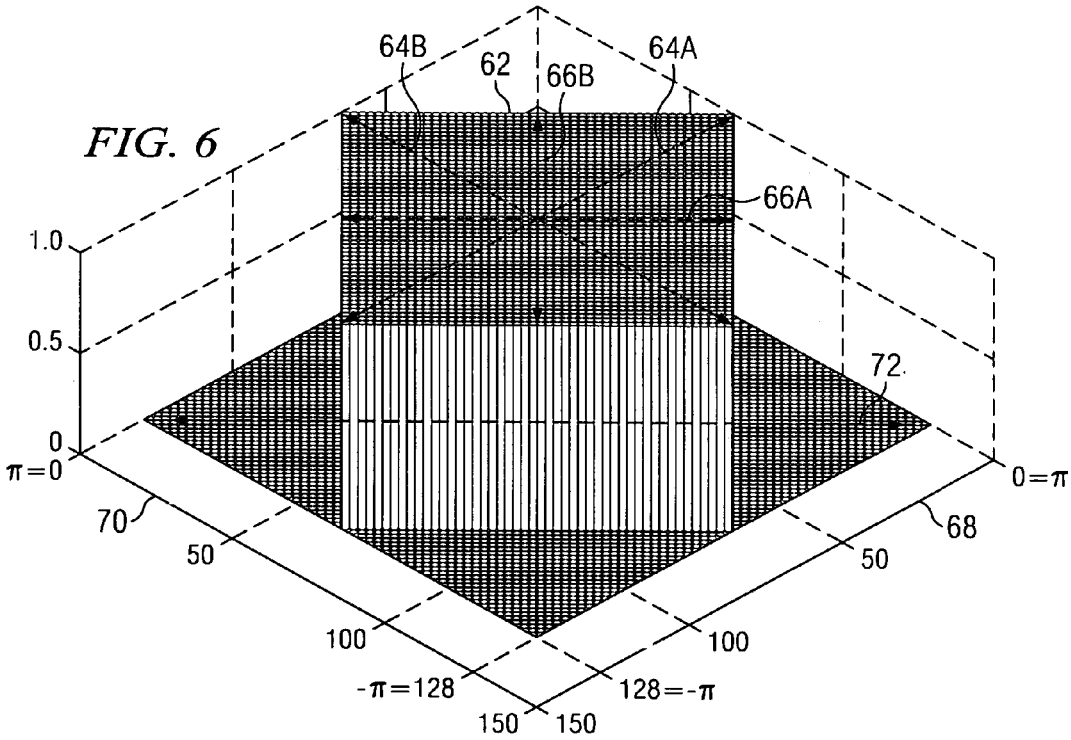
FIG. 6 is a presentation of the Horizontal and Vertical frequency responses of a diamond array as determined by FFT (Fast Fourier Transform) compared to an orthogonal array.
Figure 7A:
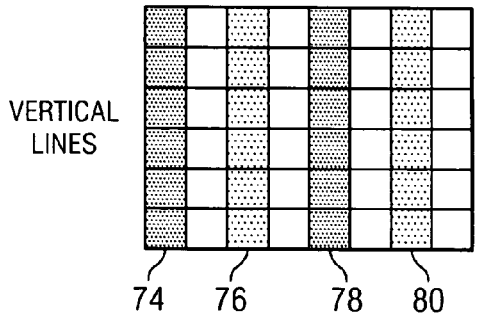
FIGS. 7A, 7B, 8A, 8B, 9A and 9B illustrate the results of reproducing vertical, horizontal and diagonal lines presented on an orthogonal array when converted to a diamond array by conventional sub-sampling of the orthogonal pixels.
Figure 7B:
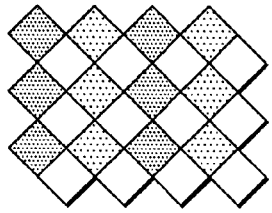
Figure 8A:
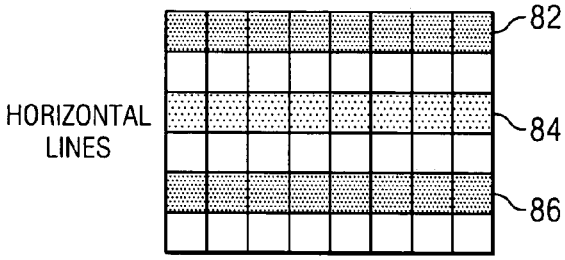
Figure 8B:
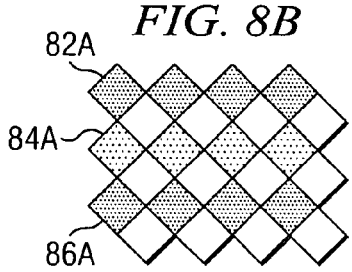
Figure 9A:
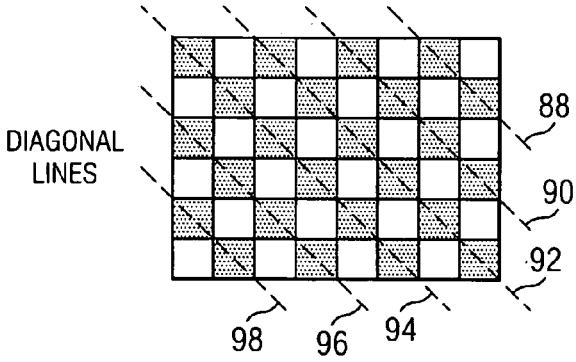
Figure 9B:
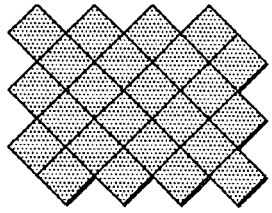
Figure 10A:
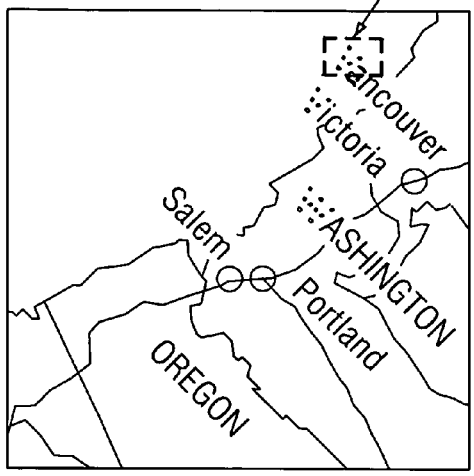
FIGS. 10A and 10B are pictorial representations of the aliasing or artifacts that occur when generating diagonal line images on a diamond-shaped array.
Figure 10C:
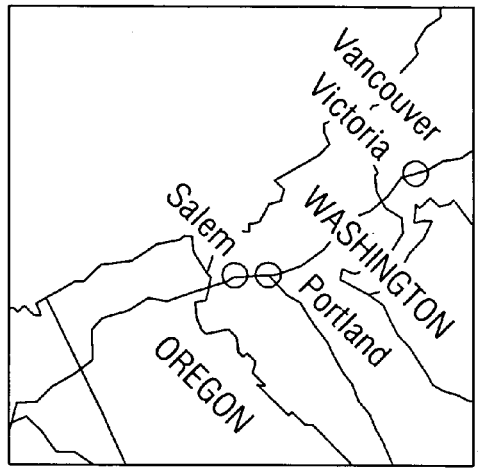
FIG. 10C illustrates how the image appears when corrected for aliasing of the type shown in FIGS. 10A and 10B.
Figure 10B:
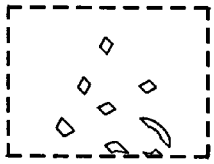

With respect to FIGS. 5A and 5B, sub-sampling of the original orthogonal data was accomplished by simply dropping all of the odd numbers of pixels for the even rows and dropping all of the even number of pixels for the odd rows. This is also shown in FIGS. 11A and 11B. However, as was also discussed, this approach created some unacceptable artifacts, and to eliminate the unacceptable artifacts, the data is passed through the IIR Linear-Phase Filter as was just discussed. However, to minimize the amount of DMD™ formatter changes needed to accommodate the diamond array, the process of this invention also interleaves the diamond rows. This can be accomplished by providing the filtered data on line 208 to the single port 210 of RAM 212 as shown in FIG. 14A prior to the detection of a vertical edge illustrated generally by circuitry 214 of FIG. 14B. RAM 212 only needs to be written to for even orthogonal rows and read from for odd orthogonal rows. That is, only data for the even orthogonal lines are stored, and line interlaced diamond rows are only produced for even orthogonal lines as indicated in FIG. 11C. Thus, as is also shown in FIG. 11C, odd data sets, i.e., 9, 11, 13 and 15 of FIG. 11A, from the even orthogonal lines are interlaced with the even data sets, i.e., 0, 2, 4 and 6, of the previous odd lines.

As was mentioned above, Ringing Minimization circuitry 146 requires some of the same data already processed by the Linear Phase IIR Filter and, therefore, is illustrated in the same block 142 of the block diagram of FIG. 12. The required data can be tapped from the IIR Filter and used by the Ringing Minimization circuitry 146. As shown in FIG. 13, the pixel data received on line 144 is also provided to "minimum" circuitry 216 and "maximum" circuitry 218. In addition, the output of delay circuit 162 is also provided as an input to both minimum circuit 216 and maximum circuit 218. The output of circuits 216 and 218 are respectively provided to circuits 220 and 222, which in turn provide outputs to limiter circuit 224.

As was briefly discussed above, a high-frequency emphasis filter 156 switches between two filters based on whether an "edge" is primarily a vertical edge or a horizontal edge.

To detect vertical edges, absolute differences between vertically adjacent pixels are calculated from the orthogonal data array before the "even" lines are decimated, i.e., pixels are dropped. If the calculated absolute differences are above a user-defined threshold, then a vertical edge has been detected and the data flow is switched to the vertical high-pass filter. For all other cases, the horizontal high-pass filter is used.

Figure 15A:
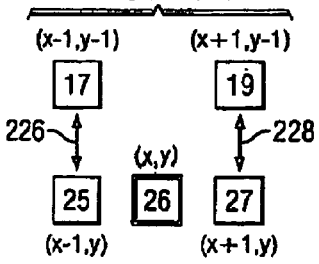
FIGS. 15A and 15B illustrate the operation of the vertical edge detection circuitry of FIG. 14B for "even" and "odd" orthogonal pixels respectively.

FIG. 15A, along with the orthogonal data array of FIG. 11A, illustrates the edge detection for "even" orthogonal pixels. As shown in FIG. 15A, the specific pixel under investigation in this example is pixel 26 from the array of FIG. 11A. Generically, this pixel 26 is identified by its location as (x,y). Then, as indicated by double-headed arrow 226 in FIG. 15A, the "absolute" difference $AV_{17,25}$ between pixels 17 and 25 is calculated. Referring again to FIG. 11A and as also shown in FIG. 15A, it is seen that the generic location of pixel 17 is (x−1, y−1) and the generic location of pixel 25 is (x−1,y). In the same manner, the absolute difference $AV_{19,27}$ between pixels 19 and 27 is calculated as indicated by double-headed arrow 228. The generic location of pixel 19 is (x+1, y−1) and the generic location of pixel 27 is (x+1,y).

From the above discussion, it will also be appreciated that the values of pixels 17 and 19 from an "odd" orthogonal line is stored in RAM. Further, pixels 25 and 27 from an "even" orthogonal line will be dropped (or decimated). The AV (absolute value) calculations may be expressed mathematically as:

$$AV_{17,25}=|((x-1,y-1)-(x-1,y))| \quad \text{Equation 6.}$$

$$AV_{19,27}=|((x+1,y-1)-(x+1,y))| \quad \text{Equation 7.}$$

Therefore, if the value $AV_{17,25}$ of equation 6 is greater than the user-defined Edge Threshold (ET) value, and the $AV_{19,27}$ of equation 7 is greater than the ET value, then a vertical edge has been detected and the vertical high-pass filter is applied across three line-interleaved pixels. Otherwise, the system considers that a vertical edge has not been detected and a horizontal high-pass filter is used.

Figure 15B:
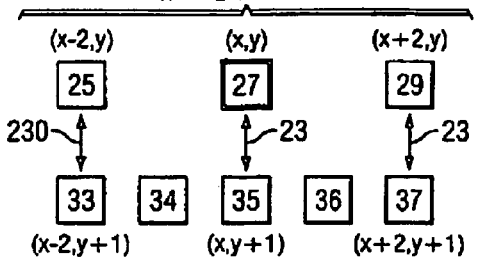

FIG. 15B, on the other hand, illustrates edge detection for "odd" orthogonal pixels. As shown, the pixel under investigation in this example is pixel 27 as illustrated in FIG. 11A. In this example, as indicated by double-headed arrow 230, the absolute difference between pixels 25 (x−2,y) and pixel 33 (x−2,y+1) is determined, as is the $AV_{27,35}$ between the pixel under investigation 27 (generic location (x,y)) and pixel 35 (x,y+1) illustrated by double-headed arrow 232, and the absolute value difference of pixel 29 (x+2,y) and 37 (x+2,y+1) as indicated by double-headed arrow 234. Therefore, expressing these calculations mathematically, the equations are:

$$AV_{25,33}=|((x-2,y)-(x-2,y+1))| \quad \text{Equation 8.}$$

$$AV_{27,35}=|((x,y)-(x,y+1))| \quad \text{Equation 9.}$$

$$AV_{29,37}=|((x+2,y)-(x+2,y+1))| \quad \text{Equation 10.}$$

Then, if all three absolute values are greater than the user-defined ET value, the vertical high-pass filter is applied across three line-interleaved pixels. Otherwise, the horizontal high-pass filter is applied across three horizontally adjacent pixels.

Figure 16A:
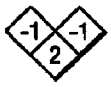
FIGS. 16A and 16B illustrate the pixel arrangement that is provided to a vertical high-pass filter and a horizontal high-pass filter respectively.
Figure 16B:
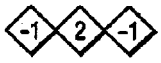

FIG. 16A illustrates the tap position and coefficients for the vertical high-pass filter applied to three line-interleaved pixels, and FIG. 16B illustrates the tap and coefficients examples for the horizontal high-pass filter applied to three horizontally adjacent pixels.

Figure 17B:
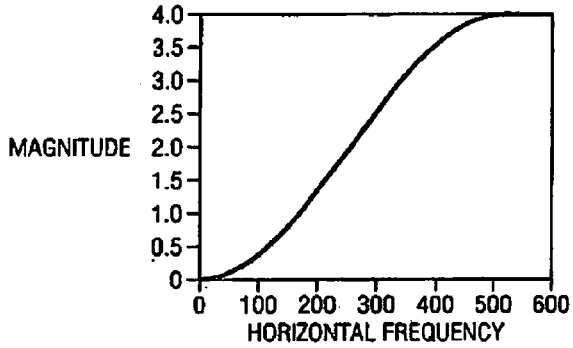
FIGS. 17A and 17B are graphs showing frequency response of the vertical and horizontal high-pass filters.
Figure 17A:
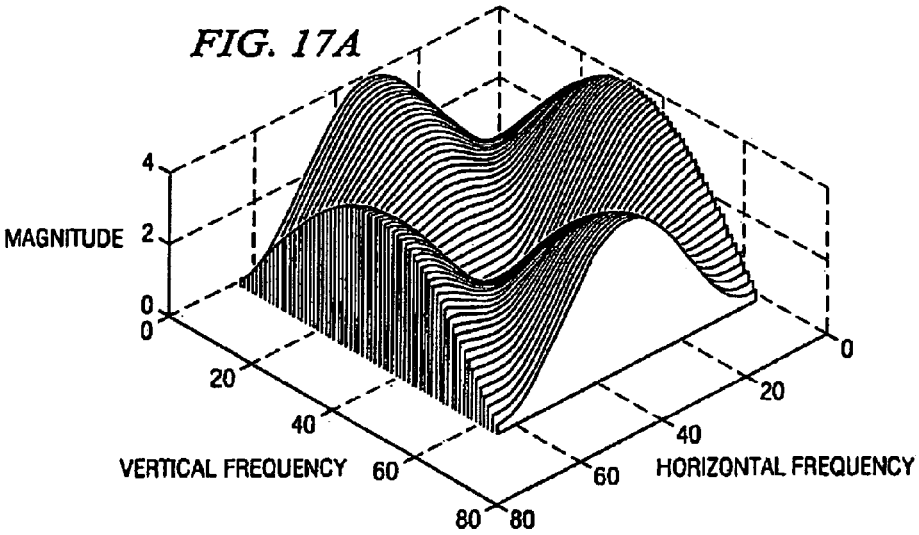
Figure 18:
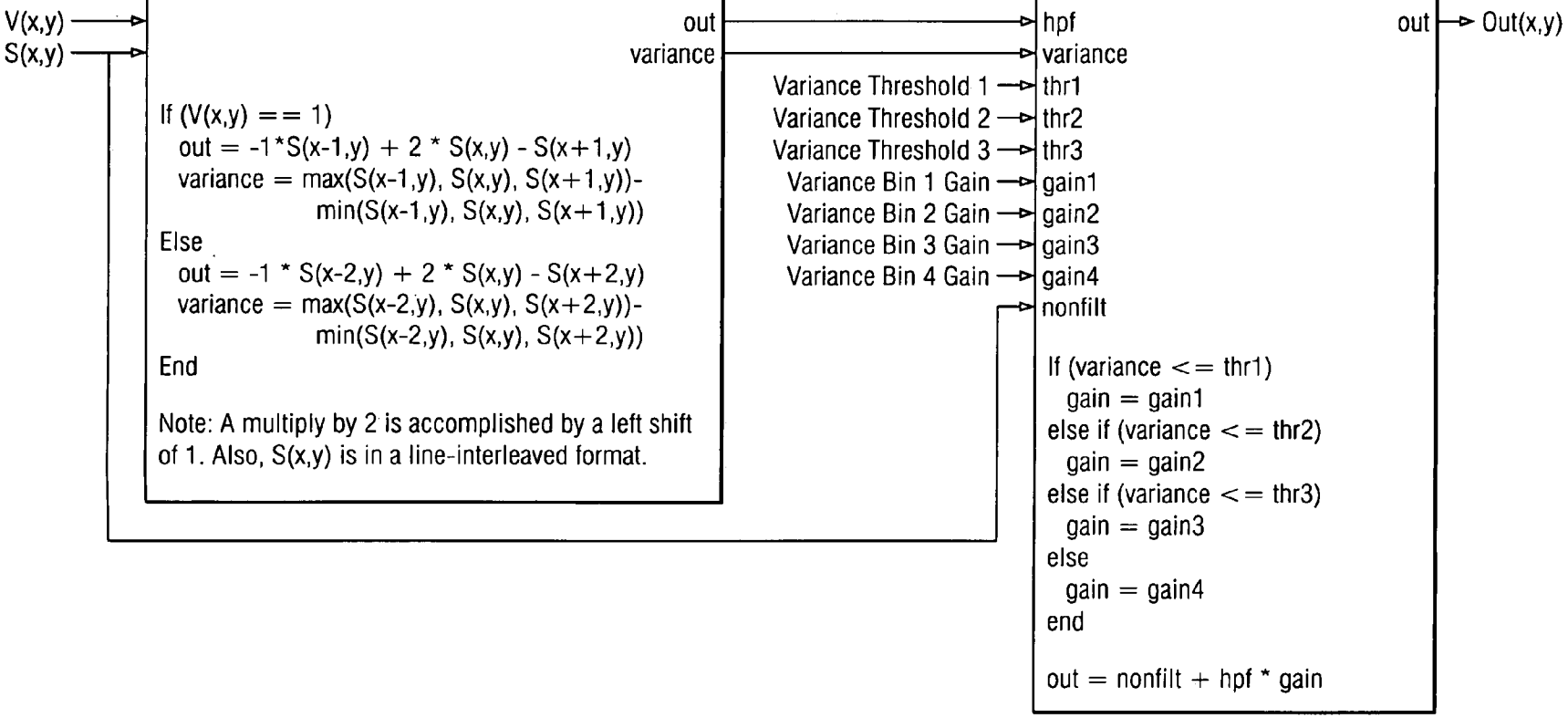
FIG. 18 is a block diagram illustrating the high-pass filters and the available gain adjustment.

The results of the selected high-pass filter (vertical or horizontal) are then added into the data stream. The inherent gain of the two high-pass filters is four (4) as illustrated in FIGS. 17A and 17B. However, the gain is altered based on the local variance of the sub-sampled data, and the local variance is estimated by taking the difference between the maximum and minimum values within the span of the filter. Thus, according to one embodiment, three user-defined thresholds define four groups or bins, and applying a particular user-defined gain depends on which bin or group the data falls in. Thus, high-frequency, low-level noise can be removed by setting the gain of the lowest group to a negative value such as, for example, −¼, whereas edge enhancement is realized by setting the other variance groups or bins to positive value gains. This process is illustrated in FIG. 18, which shows the high-pass filter and the gain adjustments.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. Circuitry for converting digital data representing an image for displaying on an orthogonal pixel array to digital data suitable for displaying said image on a diamond-shaped pixel array comprising:

a source for providing a stream of digital data signals representing said image for display on said orthogonal pixel array, said orthogonal pixel array comprising an integer x rows and an integer y columns;

a Linear-Phase IIR Filter having an input for receiving said stream of digital data signals and for providing a filtered data stream; and circuitry for sub-sampling said filtered data for use on a diamond-shaped array, said diamond-shaped array consisting of one half said integer x rows and one half said integer y columns, by dropping data to be displayed for even pixels on all odd numbered orthogonal rows of said x rows and dropping data intended for display for odd pixels on all even numbered rows of said x rows.

2. The circuitry of claim 1 further including detection circuit for receiving said filtered data and for detecting a vertical edge in said image.

3. The circuitry of claim 2 further comprising switching circuitry for receiving said sub-sampled filtered data and first and second high frequency filters, switching circuitry providing said sub-sampled filtered data to said first high frequency filter when a vertical edge is detected and to said second high frequency filter when a vertical edge is not detected.

4. The circuitry of claim 3 wherein said first filter is applied across three line-interleaved pixels when selected and said second filter is applied across three horizontally adjacent pixels when selected.

5. The circuitry of claim 4 further including circuitry for providing a selected gain of data from said first and second filters.

6. The circuitry of claim 1 wherein said Linear-Phase IIR Filter includes a plurality of stages and further comprising an output connection for providing a partial filtered output data stream;

Ringing Minimization circuit for receiving said partially filtered output data stream and for providing a ringing minimization signal; and limiter circuit for coupling said ringing minimization signal and said filtered data stream to generate a filtered data stream with reduced ringing.

7. The circuitry of claim 1:

wherein the orthogonal pixel array comprises a number of rows and a number of columns of pixels; and wherein each column in the integer y columns is linearly aligned with a pixel in a single row of the integer x rows.

8. The circuitry of claim 7:

wherein the Linear-Phase IIR Filter further comprises a node $N_3$; and further comprising circuitry for modifying pixel intensity data $N_3(x,y)$ at node $N_3$ in response to pixel intensity data relating to at least a pixel at location (x,y) and a pixel that precedes the pixel at location (x,y) by one row less one pixel in the orthogonal pixel array.

9. The circuitry of claim 1:

wherein the Linear-Phase IIR Filter comprises at least one node; and further comprising circuitry for modifying pixel intensity data at the at least one node in response to pixel intensity of a first pixel as modified by pixel intensity of a second pixel that precedes the first pixel in the orthogonal pixel array, wherein the second pixel precedes the first pixel by one row and one pixel in the orthogonal pixel array.

10. The circuitry of claim 9 wherein the circuitry for modifying modifies in response to a constant times an intensity of the second pixel.

11. The circuitry of claim 1:

wherein the Linear-Phase IIR Filter comprises a node $N_1$;

wherein the orthogonal pixel array comprises a number x of rows and a number y of columns of pixels; and further comprising circuitry for modifying pixel intensity data $I_n(x,y)$ at node $N_1$ in response to pixel intensity data relating to at least one other pixel at a location other than (x,y) and according to a constant K and:

$$N_1(x,y)=I_n(x,y)-KN_1(x+1,y-1).$$

12. The circuitry of claim 11 wherein the constant K=−0.375.

13. The circuitry of claim 11:

wherein the Linear-Phase IIR Filter further comprises a node $N_2$; and further comprising circuitry for modifying pixel intensity data $N_2(x,y)$ at node $N_2$ in response to pixel intensity data relating to at least one other pixel at a location other than (x,y) and according to:

$$N_2(x,y)=N_1(x+1,y-1)KN_1(x,y).$$

14. The circuitry of claim 13:

wherein the Linear-Phase IIR Filter further comprises a node $N_3$; and further comprising circuitry for modifying pixel intensity data $N_3(x,y)$ at node $N_3$ in response to pixel intensity data relating to at least one other pixel at a location other than (x,y) and according to:

$$N_3(x,y)=N_2(x,\ y)+KN_3(x-1,y-1).$$

15. The circuitry of claim 14:

wherein the Linear-Phase IIR Filter further comprises a node $N_4$; and further comprising circuitry for modifying pixel intensity data $N_4(x,y)$ at node $N_4$ in response to pixel intensity data relating to at least one other pixel at a location other than (x,y) and according to:

$$N_4(x,y)=N_4(x-1,y-1)+KN_3(x,y).$$

16. The circuitry of claim 15:

wherein the Linear-Phase IIR Filter further comprises a node $N_5$; and further comprising circuitry for modifying pixel intensity data $N_5(x,y)$ at node $N_5$ in response to pixel intensity data relating to at least one other pixel at a location other than (x,y) and according to:

$$N_5(x,y)=N_4(x,y)+I_n(x,y-1).$$

17. The circuitry of claim 1:

wherein the Linear-Phase IIR Filter comprises a node $N_1$;

wherein the orthogonal pixel array comprises a number x of rows and a number y of columns of pixels; and further comprising circuitry for modifying pixel intensity data $I_n(x,y)$ at node $N_1$ in response to pixel intensity data relating to at least a pixel at location (x,y) and a pixel that precedes the pixel at location (x,y) by one row and one pixel in the orthogonal pixel array.

18. A method of converting digital data representing an image for display on an orthogonal pixel array to digital data suitable for displaying said image on a diamond-shaped pixel array comprising the steps of:

providing a stream of digital data signals representing said image for display on said orthogonal pixel array, said orthogonal pixel array comprising an integer x rows and an integer y columns;

receiving said stream of digital data signals and filtering said stream of data through a Linear Phase IIR Filter to generate a filtered data stream; and sub-sampling said filtered data stream to generate a sub-sampled data stream for use on a diamond-shaped array, said diamond-shaped array consisting of one half said integer x rows and one half said integer y columns, by dropping data intended to control even pixels on all odd numbered orthogonal rows of said x rows and dropping data intended to control odd pixels on all even numbered orthogonal rows of said x rows.

19. The method of claim 18 and further comprising evaluating said filtered data stream to determine the presence of vertical edges in said image.

20. The method of claim 18 wherein said Linear Phase IIR Filter has a plurality of stages and at least one output for providing a partially filtered output data stream and further comprising the steps of:

receiving said partially filtered data stream and generating a ringing minimization signal; and combining said ringing minimization signal and said sub-sampled data stream to generate a filtered data stream with reduced ringing.

21. The method of claim 18 further comprising the steps of receiving said sub-sampled filtered data at a switch having a first and second output;

providing a first filter to be selectively applied across three line-interleaved pixels of said sub-sampled filtered data in response to being selected and a second filter to be applied across three horizontally adjacent pixels of said sub-sampled filtered data in response to being selected;

switching said sub-sampled filtered data to said first output when a vertical edge is detected in said image; and switching said sub-sampled filtered data to said second output when a vertical edge is not detected in said image.

* * * * *